US007398892B2

(12) United States Patent
Bouie

(10) Patent No.: US 7,398,892 B2
(45) Date of Patent: Jul. 15, 2008

(54) CUP AND LID COMBINATION

(75) Inventor: Tony V. Bouie, Anthem, AZ (US)

(73) Assignee: Halo Cups, Inc., Anthem, AZ (US)

( * ) Notice: Subject to any disclaimer, the term of this patent is extended or adjusted under 35 U.S.C. 154(b) by 264 days.

(21) Appl. No.: 11/297,959

(22) Filed: Dec. 8, 2005

(65) Prior Publication Data

US 2006/0157485 A1 Jul. 20, 2006

Related U.S. Application Data

(63) Continuation-in-part of application No. 10/763,520, filed on Jan. 23, 2004, now abandoned.

(51) Int. Cl.
*B65D 51/12* (2006.01)
*B65D 55/16* (2006.01)
*B65D 43/08* (2006.01)

(52) U.S. Cl. ..... 220/379; 220/213; 220/669

(58) Field of Classification Search ..... 220/375, 220/23.4, 213, 781, 379, 675, 713, 744, 23.83, 220/735, 717, 831, 832, 837, 839, 305, 669; 206/515, 514, 501; 215/306, 390; D7/509, D7/511

See application file for complete search history.

(56) References Cited

U.S. PATENT DOCUMENTS 1,755,086 A * 4/1930 Tapp ..... 81/3.09
3,069,046 A * 12/1962 Gram ..... 215/383
3,393,826 A * 7/1968 Brown ..... 206/520
3,534,736 A * 10/1970 Meyers ..... 604/78
3,810,470 A 5/1974 Von Gunten
3,841,528 A * 10/1974 Eisenberg ..... 222/143
3,900,106 A 8/1975 Cantales
D240,285 S 6/1976 Sarpaneva
4,043,478 A * 8/1977 Duncan ..... 220/710
4,420,092 A 12/1983 Finkelstein
4,573,631 A * 3/1986 Reeves ..... 229/404
5,050,759 A 9/1991 Marble
5,244,106 A 9/1993 Takacs
5,407,098 A 4/1995 Tomer
5,460,264 A 10/1995 Rupert
5,605,241 A 2/1997 Imperiloli
5,645,191 A * 7/1997 Neville ..... 220/717
D389,700 S 1/1998 Bingham
5,897,010 A 4/1999 Soyka
6,047,852 A 4/2000 Evans et al.
D434,943 S * 12/2000 Price ..... D7/509
6,164,488 A * 12/2000 Solland et al. ..... 220/834
6,176,420 B1 1/2001 Sarson et al.
D446,687 S 8/2001 Furman et al.
D461,098 S 8/2002 Lin
6,502,713 B1 * 1/2003 Baker ..... 220/523

(Continued)

*Primary Examiner*—Anthony D. Stashick
*Assistant Examiner*—Niki M. Eloshway
(74) *Attorney, Agent, or Firm*—Jeffer Mangels Butler & Marmaro LLP

(57) ABSTRACT

A cup and lid combination that includes a cup having a side wall, a closed bottom and an open top, a lid configured to close the open top of the cup, and a tether connecting the lid to the cup. In a preferred embodiment, the cup includes a band extending therearound, and one end of the tether is connected to the band, and the other end of the tether is connected to the lid.

13 Claims, 6 Drawing Sheets

U.S. PATENT DOCUMENTS

| | | | |
|---|---|---|---|
| D474,367 | S | 5/2003 | Turchi et al. |
| D477,183 | S | 7/2003 | Janky |
| D479,946 | S | 9/2003 | Jalet et al. |
| D480,601 | S | 10/2003 | Pettaweebuncha |
| 6,688,469 | B1 | 2/2004 | Barnes |
| D507,458 | S | 7/2005 | Allen et al. |
| D507,932 | S | 8/2005 | Cintron et al. |
| D507,934 | S | 8/2005 | Featherston et al. |
| D514,884 | S | 2/2006 | Smith et al. |
| D519,782 | S | 5/2006 | Schuler et al. |
| D523,692 | S | 6/2006 | Meehan |
| D529,761 | S | 10/2006 | Trombly |
| D530,569 | S | 10/2006 | Hsu |
| D530,980 | S | 10/2006 | Zerillo et al. |
| D531,854 | S | 11/2006 | Bresler |
| D535,520 | S | 1/2007 | Cundieff |
| D537,677 | S | 3/2007 | Bresler |

* cited by examiner

CUP AND LID COMBINATION

This is a continuation-in-part of application Ser. No. 10/763,520, filed on Jan. 23, 2004, now abandoned, the entirety of which is incorporated herein by reference.

FIELD OF THE INVENTION

This invention is concerned with improving the handling of nestable cups and lids for those cups.

BACKGROUND OF THE INVENTION

It is customary to configure disposable soft drink cups so that each cup can be nested in a like cup beneath it in a stack. This greatly reduces the storage space for multiple cups. Such cups are rarely supplied with lids in place on the open mouth of the cups because this would preclude the cups being nested. Hence, the lids are usually supplied and stored in a container separate from the container for the cups. And, thus, the cups and lids must be handled separately and brought together for use.

In the prior art U.S. Pat. No. 6,176,420, granted Jan. 23, 2001 to G. E. Sarson et al. for "Disposable Cup With Spill Resistant Lid" proposes to configure the cup with an integral lid that can be folded between a raised position and a semi-closed position. The construction does not allow the cup opening to be fully and reliably closed.

P. S. Takacs in his U.S. Pat. No. 5,244,106, granted Sep. 14, 1993 for "Bottle Incorporating Cap Holder" proposed to store the cap for a bottle in a recess in the base of the bottle. Of course, such an arrangement is not nestable with other like bottles.

U.S. Pat. No. 6,047,852 granted Apr. 11, 2000 to M. G. Evans et al. for "Hot Beverage Lid With Thermal Flex-Guards" proposed attaching the lid to flaps or a cylinder of heat insulating material at the wall of the cup. Again, if the cups are nested for storage the lid must be stored and handled separately.

There continues to be a need for a cup and lid combination in which these items can be stored together in a nested condition.

SUMMARY OF THE PREFERRED EMBODIMENTS

This invention proposes to provide a recess in the frustroconical wall of a nestable cup to house and retain for use a lid for the cup. The wall of the cup is preferably configured to releasably retain the lid in the recess. There may also be provided a flexible tether connecting the lid to the cup so the lid does not fall free of the cup when removed from the recess. Further, the lid may be provided with a tab to facilitate removal of the lid from the recess.

In accordance with another aspect of the present invention, there is provided a cup and lid combination that includes a cup having a side wall, a closed bottom and an open top, a lid configured to close the open top of the cup, and a tether connecting the lid to the cup. In a preferred embodiment, the cup includes a band extending therearound, and one end of the tether is connected to the band, and the other end of the tether is connected to the lid. Also, the top of the cup preferably has a convex/concave shape.

In accordance with another aspect of the present invention, there is provided a method of placing a lid on a nestable cup, the cup including a flexible tether connected at one end to the cup and at the opposite end to the lid. The method includes the steps of providing a stack of nestable cups, at least a first cup including a lid in a storage position, removing the first cup from the stack, and moving the lid from the storage position to a use position. In a preferred embodiment, the cup further includes a band extending therearound and the tether is connected at one end to the band and at the opposite end to the lid. The method can also include the step of tearing the tether, thereby separating the lid from the band.

In accordance with another aspect of the present invention, there is provided a top for a cup including a band, a lid, and a tether having its first end secured to the band and its second end secured to the lid. In a preferred embodiment, the band has a channel defined therein and includes a bottom portion and a lip extending outwardly from the bottom portion. The channel is defined in the bottom portion.

BRIEF DESCRIPTION OF THE DRAWINGS

The invention is described in greater detail hereinafter by reference to the accompanying drawings wherein.

DETAILED DESCRIPTION OF THE PREFERRED EMBODIMENTS

Figure 1:
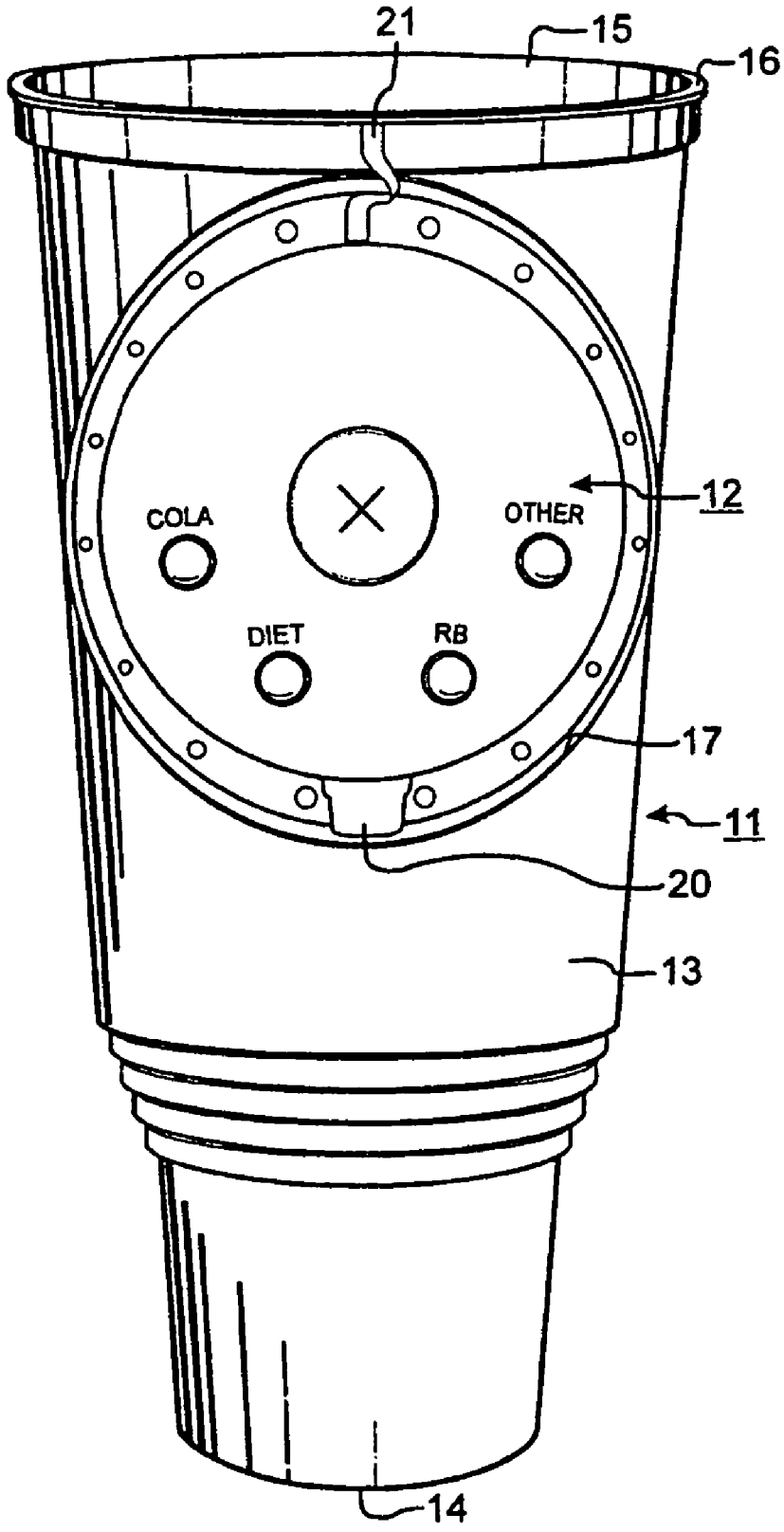
FIG. 1 is an elevational view of a first embodiment of a cup/lid combination incorporating this invention.
Figure 2:
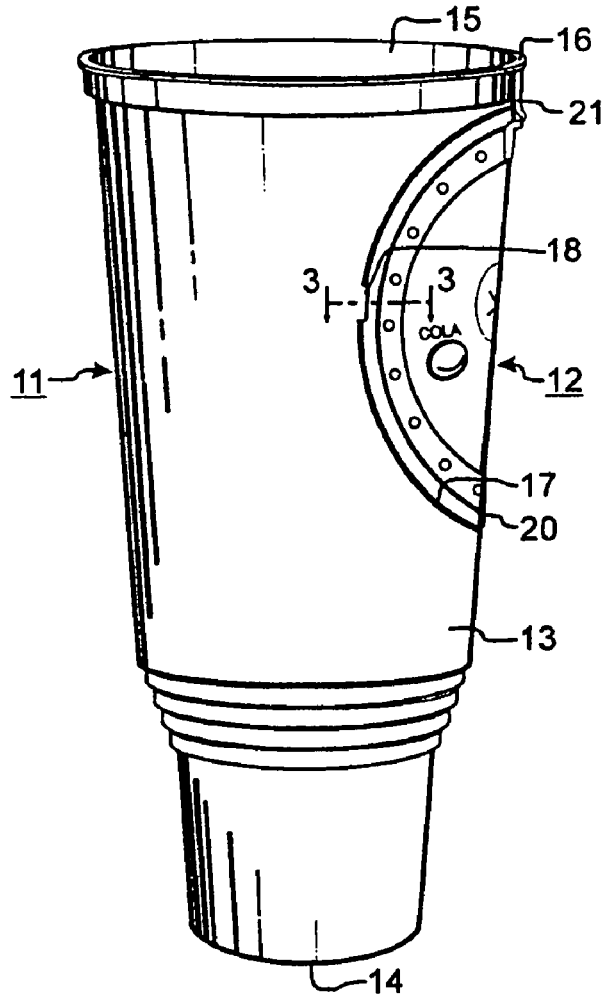
FIG. 2 is a side elevational view of the cup/lid combination of FIG. 1.
Figure 3:
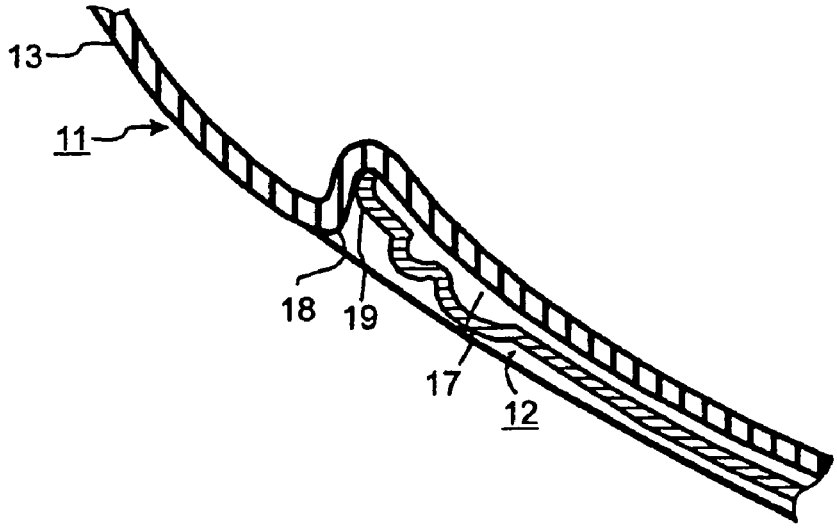
FIG. 3 is an enlarged partial sectional view of the cup/lid combination of FIG. 1 taken generally as indicated by line 3-3 in FIG. 2.

Referring to FIGS. 1-3, the numeral 11 designates generally the cup and numeral 12 designates generally the lid for the cup.

For exemplary purposes only, described hereinbelow is a preferred embodiment wherein the cups described are of a nestable variety. However, this is not a limitation on the present invention. It will be understood that the cup/lid combinations taught herein can by used with any type of cup or vessel that includes a lid. Other uses for the cup/lid combinations described herein will be readily apparent to those skilled in the relevant art.

It will be appreciated that terms such as "top," "bottom," "side," "upwardly" and other such descriptive terms used hereinbelow are merely for ease of description and refer to the orientation of the components as shown in the figures. It should be understood that any orientation of the cup/lid combinations described herein is within the scope of the present invention.

Cup 11 is a nestable variety, meaning that it can be stacked with a cup nesting inside a cup therebeneath in a stack. To this end cup 11 has a frustroconical wall 13 with a closed bottom 14 and an open top 15. The cup preferably has a thickened or rolled lip 16 at the open top 15.

The wall 13 of cup 11 has a circular recess 17 therein for receiving the lid 12. In the view of the recess 17 there are provided one or more pairs of oppositely disposed nubs 18 which are adapted to overlie and retain the periphery 19 of the lid 12 when it is positioned within recess 17. (Only one such nub 18 is shown in the drawings at FIG. 2 and in enlarged section in FIG. 3.)

Both the cup 11 and the lid 12 are preferably formed of thin wall flexible plastic materials thus enabling the lid 12 to be bent and flexed in placing it in recess 17 beneath cup nubs 18 and to likewise flex when the lid 12 is snapped out of the recess 17 for use in covering the open top 15 of the cup.

If desired a tab 20 may be affixed to or be integral with the lid 12 to facilitate removing the lid from the cup wall recess 17.

Also, if desired the combination may include a flexible tether 21 providing a connection between the lid and the cup. The tether 21 prevents the lid from flying free when it is pulled from the recess 17 in the cup wall 13.

From the foregoing it should be apparent that with the cup lid 12 nestled within the recess 17 of the cup wall 13 the cup and lid can be nested within another like cup/lid combination for stacked storage and dispensing.

In another embodiment, the recess 17 can include a lip, similar to lip 16 for retaining the lid 12. In this embodiment, instead of being nestled within recess 17, the lid 12 is snap fit onto the lip within recess 17, just as it is typically snap fit onto lip 16 when in use. In this embodiment, the cups are still nestable because the lip is located within recess 17. In use, the lid 12 is removed from the lip in recess 17 and is then placed on lip 16. In yet another embodiment, recess 17 can be omitted, and a lip for retaining lid 12 can be formed on the side wall 13 of cup 11.

Figure 4:
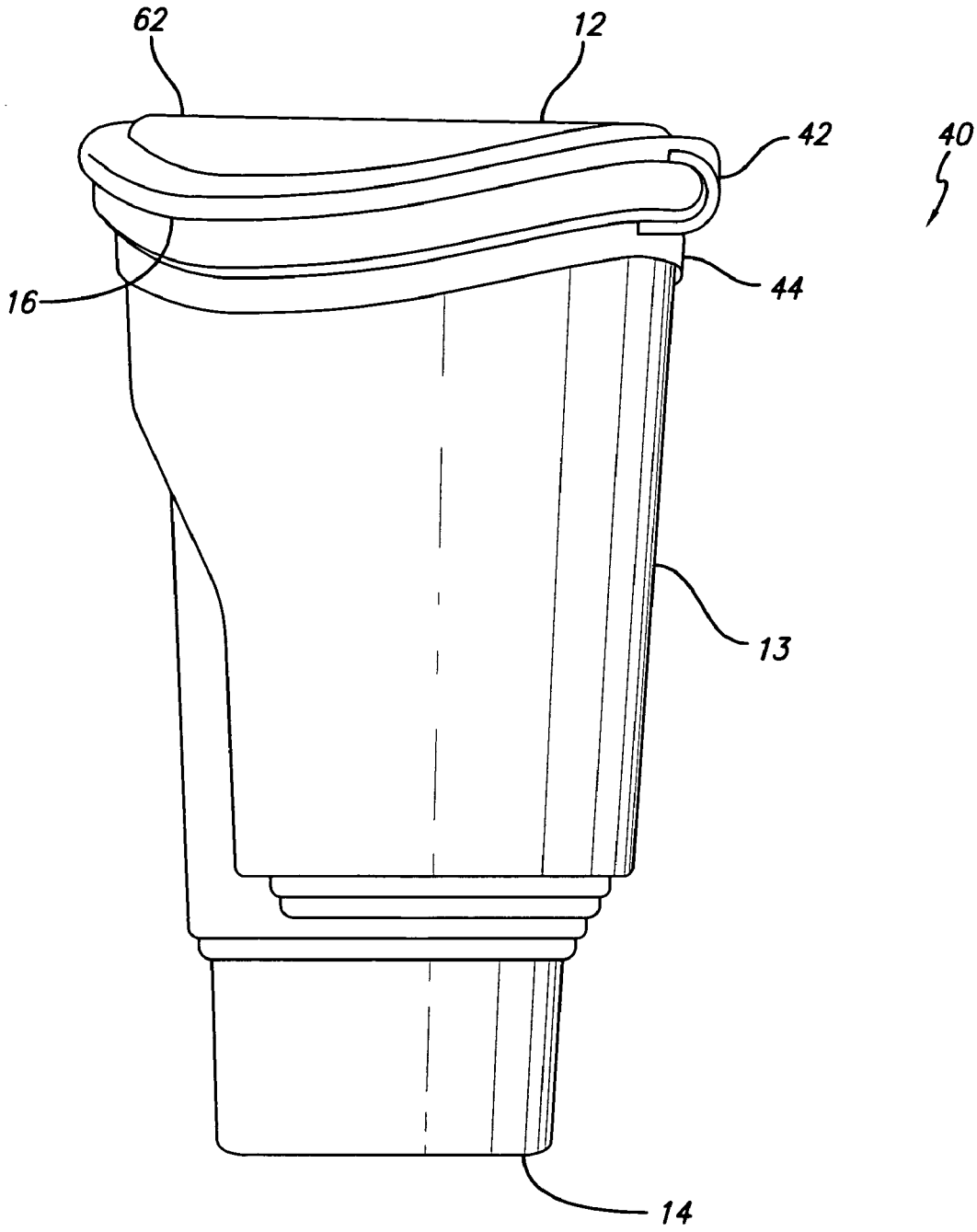
FIG. 4 is a perspective view of a second preferred embodiment of a cup/lid combination.
Figure 5:
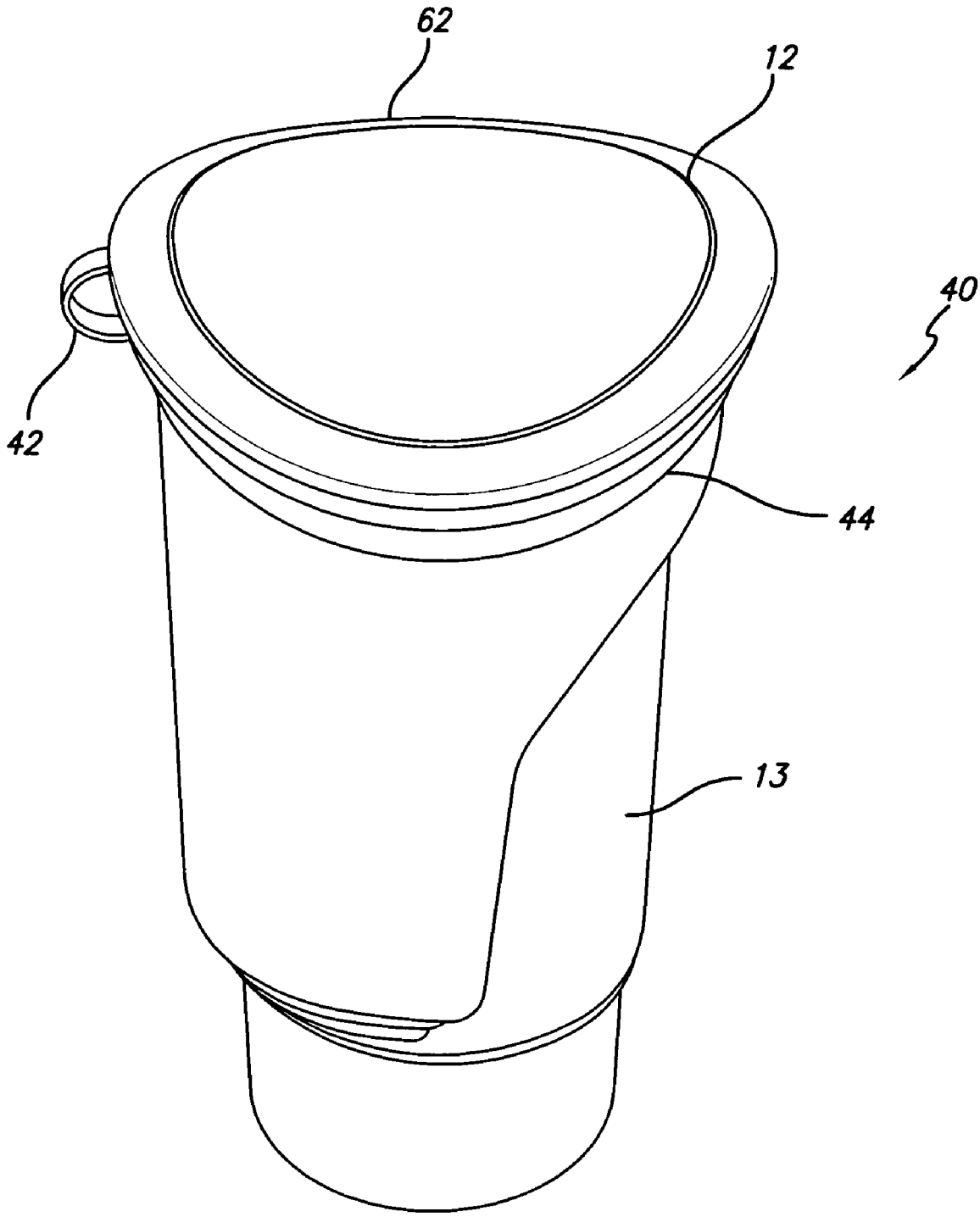
FIG. 5 is another perspective view of the cup/lid combination of FIG. 4.
Figure 6:
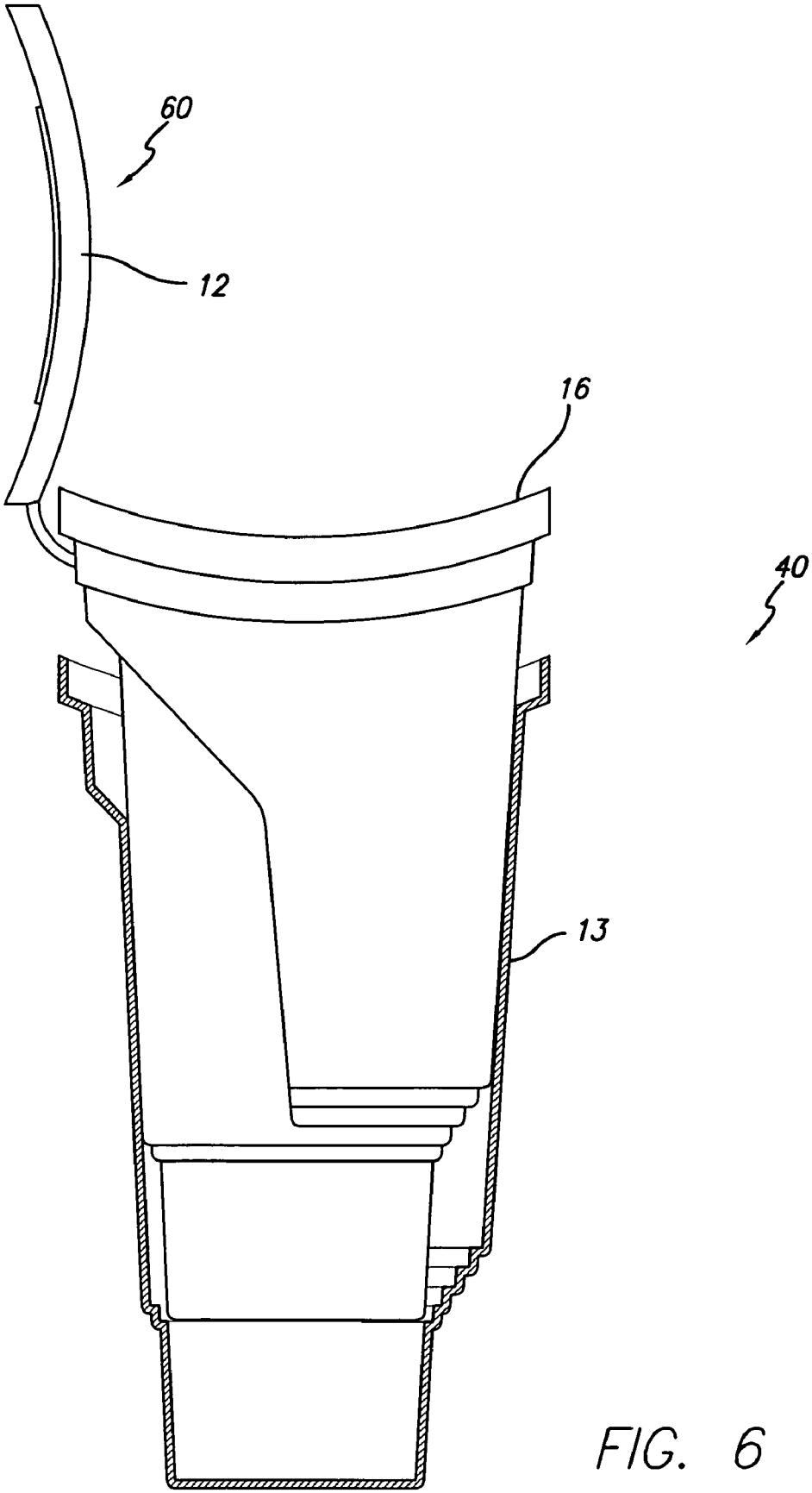
FIG. 6 is a side elevational view of two of the cups of FIG. 4 showing that they are nestable.

Referring to FIGS. 4-6, a second embodiment of a cup/lid combination is shown. Cup 40 is similar to cup 11, but has recess 17 omitted. Cup 40 is preferably a nestable variety. To this end cup 40 has a frustroconical wall 13 with a closed bottom 14 and an open top 15. The cup preferably has a thickened or rolled lip 16 at the open top 15.

In a preferred embodiment, cup 40 includes flexible tether 42 and band 44. The band 44 extends around the cup 40 preferably just under lip 16. The band 44, tether 42 and lid 12 together form a top for the cup 40. As shown in FIGS. 4 and 5, the tether 42 is connected at one end to the band 44 and at its opposite end to the lid 12. In an alternative embodiment, the tether 42 can be attached to or formed with the cup 40 itself, thus eliminating the need for band 44.

In an alternative embodiment, the band 44 is seated in a shallow channel that is formed in the side wall 13 of the cup 40. In a preferred embodiment, the channel can be omitted.

As is best shown in FIG. 4, in a preferred embodiment, the top 15 of cup 40 has a convex/concave shape. In other words, when viewed from one side (as shown in FIG. 6), the top 15 has a concave shape. When the cup 40 is turned 90 degrees from the position shown in FIG. 6 the top 15 has a convex shape. This configuration is referred to herein as a convex/concave shape and will be readily understood by those skilled in the art. After being stored for a period of time, lid 12 takes on a shape similar to that shown in FIGS. 4 and 5. This is because in storage, lid 12 points upwardly, as shown in FIG. 6. When the stack of cups 40 is placed in a sleeve, the lid 12 of a lower cup 40 typically contacts some of the cups 40 above it in the stack. Because the cups 40 are round and the cups 40 and lids 12 are secured in a sleeve, the lids 12 tend to mirror the shape of the cups, thus giving the lids 12 a convex/concave shape.

This convex/concave shape substantially corresponds to that of top 15 of cup 40 Therefore, the top 15 of cup 40 and lip 16 are preferably shaped in a non-flat or convex/concave shaped manner to accommodate the shape of lid 12 after storage. In an alternative embodiment, the lid 12 can have a convex/concave shape when manufactured. In this embodiment, the lid 12 and top 15 of cup 40 are both shaped so as to fit one another before the lid 12 is placed in the storage position (as described below).

In use, lid 12 is moved between a storage position 60 and a use position 62. As shown in FIG. 6, the lid 12 starts in the storage position 60. A user first removes the cup 40 from the stack. However, the tether 42 keeps the lid 12 attached to the lid 12, so that it does not drop to the floor, counter, etc. The user then fills the cup 40 with a beverage and places the lid 12 on the cup, which is referred to herein as the use position 62.

In a preferred embodiment, the band 44 is disposable. In this embodiment, after removing cup 40 from the stack, the user tears the tether 42, thereby separating the band 44 from the lid 12 and then places the lid 12 on the cup 40 in the use position 62. After the lid 12 is separated from the band 44, the band 44 can then be disposed of.

In yet another embodiment, the lid 12 can be stored inside cup 40. In use, the lid 12 is moved between a storage position, a filling position and a use position. It will be understood that the filling position is any position where the lid 12 is out of the cup 40 and not in the way when the cup 40 is being filled.

Preferably, the lid 12, band 44 and tether 42 are formed of a unitary piece of material. In an alternative embodiment, the lid 12, band 44 and tether 42 are formed of separate pieces that are attached to one another. Furthermore, the lid 12, band 44 and the tether 42 are preferably formed of thin wall flexible plastic materials thus enabling the lid 12 and tether to be bent and flexed when the lid is moved from the storage position to the use position. Also, the thin wall flexible plastic material allows for easy tearing of the tether in the embodiment where the band 44 is disposable. In another embodiment, where the band 44 is omitted, the lid 12, tether 42 and cup 40 are formed of a unitary piece of material.

Figure 7:
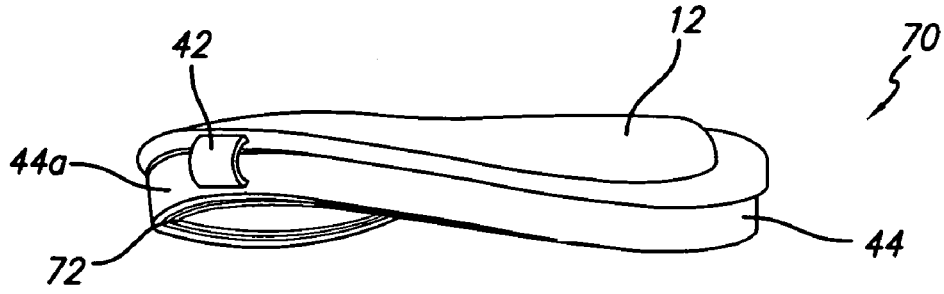
FIG. 7 is a perspective view of another embodiment of the present invention showing the top and lid without the cup.
Figure 8:
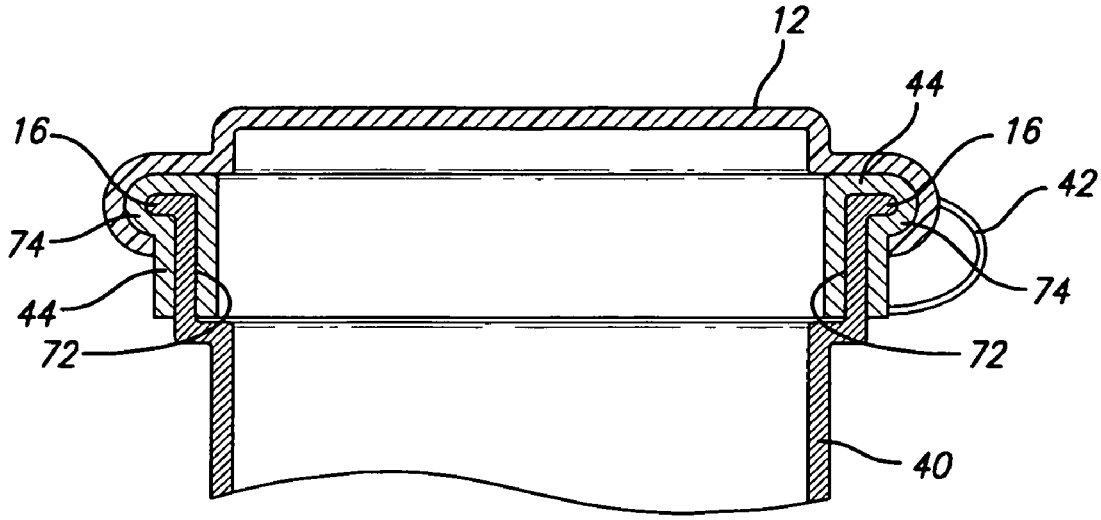
FIG. 8 is a cross-sectional view of a portion of a cup showing the top and lid of FIG. 7 secured on the lip of a cup.

A third preferred embodiment of the present invention is shown in FIGS. 7-8. In this embodiment, a top 70 includes a band 44 that is fitted around the lip 16, and a lid 12 that is connected to the band 44 by a tether 42. The band 44 includes a channel 72 for receiving the lip 16 of the cup 40. As can be seen in FIG. 8, the lip 16 of the cup 40 is received in the channel 72. The top 70 is preferably made of an elastomeric material, such as plastic or the like. Accordingly, the top 70 can be snap fit on the top 15 of the cup 40 by mating the channel 72 and the lip 16 of the cup 40. Preferably, the band 44 also includes a lip 74. In use, the lid 12, which is secured to the bottom portion **44*a* of the band 44 is snap fit onto the lip 74 of the band. As can be seen in FIG. 8, the channel 72 is defined in the bottom portion 44*a* of the band 44 and extends upwardly into the lip 74. In an alternative embodiment, the channel 72 can be defined only in the bottom portion 44*a* of the band 44. In this embodiment, the top 70** can be used on a cup without a lip and can therefore provide a lip for the cup and the capability of securing a lid thereon.

As can be seen in FIG. 7, in a preferred embodiment, the top 70 has a non-flat or convex/concave shape similar to that described above with respect to the second embodiment of the present invention. However, the top 70 can also have a flat configuration, as is shown in FIG. 8. It will be understood by those skilled in the art, that in this embodiment, the cup 40 can simply a prior art cup that has the top 70 secured thereon.

In this embodiment, the tether 42 can be tearable or not. However, in the event that the tether 42 is torn, because the band 44 is secured around the lip 16, the tether 42 is not disposable as it is in the embodiment described above.

In use, the cups 40 come in a stack with the top 70 secured to the lip 16 of the cup. The lid 12 is in the open or storage position, so that the cups 40 can all fit in one another. A user pulls a cup 40 from the stack, fills the cup 40 and closes the lid 12, thus placing the lid 12 in the use position. This method is advantageous for both the user and the establishment selling the cup and/or drink. The user does not have to take a cup from one stack and a lid from a separate stack. Moreover, because the lid is already attached to the cup, there is little chance of lids being wasted. In other words, the user will not pull two lids accidentally from a stack and drop one on the floor. The user saves time and the establishment saves money and inventory.

The embodiments described above are exemplary embodiments of the present invention. Those skilled in the art may now make numerous uses of, and departures from, the above-described embodiments without departing from the inventive concepts disclosed herein. Accordingly, the present invention is to be defined solely by the scope of the following claims.

What is claimed is:

1. A cup and lid combination comprising:

a. a cup having a side wall, a closed bottom and an open top, wherein the top of the cup defines a horizontal plane, wherein the top of the cup includes at least two convex portions that extend above the horizontal plane and at least two concave portions that extend below the horizontal plane, b. a lid configured to close the open top of the cup, wherein the lid is shaped to correspond to the top of the cup, including the convex and concave portions, and c. a recess defined in the wall of the cup configured to receive the lid.

2. The cup and lid combination of claim 1 wherein the side wall of the cup is frustoconical, thereby making the cup nestable.

3. The cup and lid combination of claim 2 wherein both the cup and the lid are formed of thin wall plastic material.

4. A cup assembly comprising:

a cup having a frustoconical wall, a closed bottom and an open top, a lid configured to close the open top of the cup, and a recess defined in the wall of the cup configured to receive the lid, wherein the lid is formed of a flexible material and is positioned in the recess in the wall of the cup, wherein the recess is at least partially defined by a retaining member that overlies at least a portion of the periphery of the lid, and wherein when the lid is positioned in the recess, the lid is only secured to the cup by the retaining member, wherein the lid has a top and a bottom and the cup has outer surface, and wherein the bottom of the lid is adjacent the outer surface of the cup when the lid is positioned in the recess, and wherein the bottom of the lid receives the open top of the cup.

5. The cup assembly of claim 4 wherein the top of the cup is non-flat.

6. The cup assembly of claim 4 wherein the top of the cup has a convex/concave shape.

7. The cup assembly of claim 6 wherein the lid has a convex/concave shape corresponding to the convex/concave shape of the top of the cup.

8. The cup assembly of claim 7 wherein the side wall of the cup is frustoconical, thereby making the cup nestable.

9. A method of storing a lid, the method comprising the steps of:

providing a cup having a if frustoconical wall, a closed bottom, an open top, and a recess defined in the wall of the cup configured to receive the lid, wherein the recess is at least partially defined by a retaining member, and wherein the lid closes the open top of the cup, removing the lid from the top of the cup, such that the lid is separate from the cup, inserting the lid into the recess, and placing at least a portion of the periphery of the lid under the retaining member, wherein when the lid is positioned in the recess the lid is only secured to the cup by the retaining member, wherein the lid has a top and a bottom and the cup has outer surface, and wherein the bottom of the lid is adjacent the outer surface of the cup when the lid is positioned in the recess, and wherein the bottom of the lid receives the open top of the cup.

10. The method of claim 9 further comprising the step of flexing the lid.

11. The method of claim 9 wherein the top of the cup is non-flat.

12. The method of claim 9 wherein the top of the cup has a convex/concave shape.

13. The method of claim 12 wherein the lid has a convex/concave shape corresponding to the convex/concave shape of the top of the cup.

* * * * *